US008308616B1

(12) United States Patent
Flavell

(10) Patent No.: US 8,308,616 B1
(45) Date of Patent: Nov. 13, 2012

(54) HALO POSTURE HEADBAND NECK TRAINING DEVICE

(76) Inventor: Scott H. Flavell, La Jolla, CA (US)

( * ) Notice: Subject to any disclaimer, the term of this patent is extended or adjusted under 35 U.S.C. 154(b) by 318 days.

(21) Appl. No.: 12/726,275

(22) Filed: Mar. 17, 2010

Related U.S. Application Data

(60) Provisional application No. 61/161,035, filed on Mar. 17, 2009.

(51) Int. Cl.
*A63B 21/065* (2006.01)
*A63B 23/025* (2006.01)

(52) U.S. Cl. ..... 482/10; 482/105

(58) Field of Classification Search ..... 482/10, 482/11, 92, 93, 105; 602/17, 18, 74; 601/39; 2/171.2, 171.04, 200.2, 209.13, 209.3, DIG. 11; 607/109, 110; 224/181
See application file for complete search history.

(56) References Cited

U.S. PATENT DOCUMENTS

| | | | | |
|---|---|---|---|---|
| 500,686 | A | 7/1893 | Corker | |
| 1,324,975 | A | 12/1919 | Morris | |
| 3,159,160 | A | 12/1964 | Ullom | |
| 3,374,636 | A | 3/1968 | Mason | |
| 3,532,339 | A | 10/1970 | Smith | |
| 3,820,780 | A | 6/1974 | Tarbox | |
| D235,789 | S | 7/1975 | Eberhardt | |
| 4,036,213 | A | 7/1977 | Gregory | |
| 4,195,833 | A | 4/1980 | Svendsen | |
| 4,204,543 | A | 5/1980 | Henderson | |
| 4,632,389 | A * | 12/1986 | Moss | 482/105 |
| 4,988,093 | A | 1/1991 | Forrest, Sr. et al. | |
| 5,088,504 | A | 2/1992 | Benesh et al. | |
| 5,162,027 | A | 11/1992 | Robinson | |
| 5,295,949 | A | 3/1994 | Hathaway | |
| 5,305,470 | A | 4/1994 | Mckay | |
| 5,991,651 | A | 11/1999 | Labarbera | |
| 6,110,080 | A | 8/2000 | Niv | |

(Continued)

FOREIGN PATENT DOCUMENTS

EP 199102 A2 * 10/1986

(Continued)

OTHER PUBLICATIONS

Saunders, E. Stephen; Woggon, Dennis; Cohen, Christian; and Robinson, David H.; "Improvement of Cervical Lordosis and Reduction of Froward Head Posture with Anterior Head Weigthing and Proprioceptive Balancing Protocols", J. Vertebral Subluxation Res,, Apr. 27, 2003, 5 pages.

(Continued)

*Primary Examiner* — Loan Thanh
*Assistant Examiner* — Victor K Hwang
(74) *Attorney, Agent, or Firm* — Albert W. Watkins

(57) ABSTRACT

A Halo Posture head weight is comprised of two consecutive rings. A lower ring is hollow and conformal while also being shape-sustaining to fit comfortably around the skull at approximately the level of the forehead. An upper ring has metal shot in the forward half to apply weight load at the frontal section of the head. Both rings have adjustable closures at the back of the head for a comfortable, adjustable, and secure fit. Additional pads are provided for coupling extra weight, to permit correction of tilt or adjustment of weight loading. In a preferred embodiment, the rings are fabricated from a single strip of double-backed neoprene that is formed using two longitudinally extensive stitch lines, and an additional resilient fabric bag is provided for securing the metal shot in the upper ring.

17 Claims, 2 Drawing Sheets

U.S. PATENT DOCUMENTS

| | | | | |
|---|---|---|---|---|
| 6,190,288 | B1 | 2/2001 | Fisher | |
| 6,299,613 | B1 | 10/2001 | Ogilvie et al. | |
| 6,325,802 | B1 | 12/2001 | Frigg | |
| 6,517,506 | B1 | 2/2003 | Pettibon | |
| 6,788,968 | B2 | 9/2004 | Pettibon | |
| 7,104,926 | B2 * | 9/2006 | Carlson | 482/10 |
| 7,189,192 | B2 | 3/2007 | Edgeton | |
| 7,322,977 | B2 | 1/2008 | Pettibon | |
| D566,799 | S * | 4/2008 | Flavell et al. | D21/683 |
| 7,468,019 | B2 | 12/2008 | Zylstra | |
| 2003/0073549 | A1 | 4/2003 | Hatch | |
| 2004/0043875 | A1 | 3/2004 | Lederfeind | |
| 2004/0198566 | A1 * | 10/2004 | McCluskey | 482/105 |
| 2007/0042869 | A1 | 2/2007 | Pettibon | |
| 2008/0274858 | A1 * | 11/2008 | Flavell et al. | 482/10 |

FOREIGN PATENT DOCUMENTS

| | | | |
|---|---|---|---|
| FR | 2724842 | A1 * | 3/1996 |

OTHER PUBLICATIONS

Morningstar, Mark W., Woggon, Dennis, and Lawrence, Gary, "Scoliosis Treatment using a Combination of Manipulative and Rehabilitative Therapy: A Retrospective Case Series", BMC Musculoskeletal Disorders 2004, 5:32, 10 pages.

* cited by examiner

HALO POSTURE HEADBAND NECK TRAINING DEVICE

CROSS REFERENCE TO RELATED APPLICATIONS

This application claims priority to U.S. provisional application Ser. No. 61/161,035 filed Mar. 17, 2009, the contents of which are incorporated herein by reference in entirety.

BACKGROUND OF THE INVENTION

1. Field of the Invention

The present invention pertains most generally to surgery, and more particularly to kinesitherapy. Most particularly, the present invention pertains to a therapeutic neck exercising appliance suitable for musculoskeletal treatment of the neck or cervical spine. A preferred embodiment illustrates a head weighting appliance that loads the spine in a manner to evoke the body's righting reflexes as an adjusting procedure for spinal correction, rehabilitation, and maintenance.

2. Description of the Related Art

The spine is comprised of four curvatures: the cervical curvature, the thoracic curvature, the lumbar curvature, and the sacral curvature. The curves of the spine, along with the intervertebral discs, help to absorb and distribute the stresses and forces from gravity and everyday movement and impact. When the curvature of the spine is altered from that which is natural, pain and damage may occur to the spine, back, neck, shoulders, and more.

Several approaches and methodologies to fixing the spinal column have been taken in the past. One such approach has been vertebral fusion. In lieu of vertebral fusion, doctors have used various alternative methods of surgery. An alternative method of surgery is the use of a "Method for the Correction of Spinal Deformities Through Vertebral Body Tethering Without Fusion" as depicted in U.S. Pat. No. 6,299,613 to Ogilvie et al, the contents and teachings which are incorporated herein by reference, which discloses a "fusionless method of treating spinal deformities . . . [involving a] device for tethering the spine." Another surgical approach, the "Spinal Fixation Element" of U.S. Pat. No. 6,325,802 to Frigg, the contents and teachings which are incorporated herein by reference, is in the form of a pedicle screw which works in combination with a longitudinal support system. In general, back surgeries cause additional damage to the tissues in the area of operation, necessitating a long and painful period of convalescence which may or may not result in complete recovery. In addition, the risks associated with such back surgeries are also great, and in some cases lead to irrecoverable further morbidity or mortality.

An alternative to surgery on the spinal column was developed taking into consideration the physiology of the body. Exercise and motion facilitate the proper functioning of the rest of the body, as can be noted in the large variety of exercise equipment advertised to improve health and physique. Adding additional resistance to the work of any given muscle for a short period of time trains the muscle to work harder to balance the environment. When the resistance is removed, the muscles continue to compensate for the resistance that is no longer there, making the regular amount of resistance feel negligible. This is seen in devices such as the "Exercise Belt and Weight System" of US Published Patent Application 2004/0043875 to Lederfeind, the contents and teachings which are incorporated herein by reference, which allows for an adjustably weighted band to be worn about the waist of a user, increasing the rigor of any exercise routine. Similarly, weighted bands have been used for exercising specific muscle groups, such as the face, neck, and jaw, as seen in U.S. Pat. Nos. 4,195,833 to Svendsen and Des. 235,789 to Eberhardt, the contents and teachings of each which are incorporated herein by reference. Bands have also been used for medicinal purposes, as seen in the "Headache Bandage" of U.S. Pat. No. 1,324,975 to Morris, the contents and teachings which are incorporated herein by reference.

This knowledge, when applied to the spinal curvatures, has one adding additional exercise, motion, and resistance to the spine. By adding additional weight to the spine, the soft tissue surrounding and supporting the spine is exercised and trained to withstand the additional force, making everyday activities less strenuous and painful. The spinal exercise provides the additional benefit of encouraging and redeveloping the natural curvatures of the spinal column as the muscles strengthen. Several approaches to using this method are seen in existing patents. One such approach is a "Therapeutic Exercising Apparatus and the Method for the Neck" seen in U.S. Pat. No. 7,189,192 to Edgeton, the contents and teachings which are incorporated herein by reference. The exercising apparatus disclosed is comprised of a helmet attached to a resilient elastic tether which is held in place by the feet or legs. A variety of head movements exercise and strengthen the neck. Similarly, U.S. Pat. No. 7,468,019 to Zylstra, the contents and teachings which are incorporated herein by reference, illustrates a "Neck Exercising Machine" comprised of adjustable tensioned cables which connect to a head band to provide resistance as one performs a variety of head movements. Both such devices are somewhat larger and more obtrusive, while also requiring specific time set aside for exercising the neck. Time is a precious commodity which is not easily available to many individuals, meaning prescribing these devices results in substantially greater percentages of patient non-compliance, or said another way, patients refuse to make the time to use such apparatus.

Another "Neck Exercising Device and Method" is found in U.S. Pat. No. 5,162,027 to Robinson, the contents and teachings which are incorporated herein by reference. The neck exerciser illustrated is designed for use while lying prone and moving the head up or down. This device has adjustable weights and straps, including a chin strap. Such a device also has the discomfort of the weight band applied directly to the crown of the skull and pulled down by the chin strap, with the crown of the skull holding it up. The force of the chin strap is, consequently, applied through the band in a compressing manner to the skull. The chin strap is not only undesirable owing to the compressive forces, but is also uncomfortable and unsightly. This neck exerciser also requires time to be set aside specifically for exercising, which is again less than ideal in the lifestyles of many.

An alternative to the Robinson patent is found in a full skull cap with means for applying a mechanical load to the cervical and upper thoracic spine, as illustrated in US published patent application 2003/0073549 to Hatch and entitled "Neck Exerciser", the contents and teachings which are incorporated herein by reference. The skull cap with chin straps illustrated therein is comprised of a hook and pile material. This design allows for the mating of weights adhered to a complementary hook and pile material to the skull cap. It allows for the additional securement of a circular halo with pockets for accepting weights as opposed to the individual attachment of weights. A similar design is found in the "Therapeutic Headpiece" of U.S. Pat. No. 6,110,080 to Niv, the contents and teachings which are incorporated herein by reference. Niv's design illustrates a skull cap with tubes for receiving weights as well as one or more removable cover members for adding additional weights. Yet another weighted skull cap is seen in U.S. Pat. No. 3,820,780 to Tarbox, the contents and teachings which are incorporated herein by reference, entitled "Head Weight and Method of Use". The head weight disclosed has a vertical tube filled with shot by the ear on both sides of the head. Overall, it weighs at least eight pounds, which is far too much for the average individual. As a group, such designs lack real adjustability for the user's head size. Additionally, full skull caps pose a greater likelihood of discomfort, whether due to a poor fit, poor interaction with the user's hair, or the increased insulation in an already warm environment.

Yet another method of strengthening the soft tissue surrounding the spinal column is seen in U.S. Pat. No. 500,686 to Corker, entitled "Gravity Helmet", the contents and teachings which are incorporated herein by reference, which is a head weight shaped in any number of ways, including: bars running from the front of the head to the back with a connecting bar across the top to hold it, together with gravity, in place; a horseshoe shaped weight; or a halo shaped weight. This "gravity helmet" is designed to support proper posture and, consequently, the proper curvatures of the back, but must be kept in position by the wearer remaining in upright position. Consequently, a user must again set aside time or significantly alter normal activity. Similarly, U.S. Pat. No. 4,988,093 to Forrest, Sr. et al., the contents and teachings which are incorporated herein by reference, entitled "Fluid-Filled Neck Exerciser" is a halo filled to adjustable levels with a liquid to apply weight to the spine. While the "Fluid-Filled Neck Exerciser" appears to contour to the user's head, neither the "Fluid-Filled Neck Exerciser" nor the "Gravity Helmet" have sizing adjustable to each individual, posing difficulties in use. Additionally, the positioning of the weight is not readily controlled, making it difficult to correct a tilt to the cervical curvature while requiring the user to dedicate time away from other activities.

Yet another approach is seen in published patent application 2007/0042869 to Pettibon, entitled "Head Weighting System for Spinal Treatment", the contents and teachings which are incorporated herein by reference. The head weighting system disclosed is comprised of a ring headpiece held in place on the head by a system of three adjustable straps going around and across the top of the head. In this design, the weight is removable and adjustable, using a plurality of pockets for retaining weights. The several large, discrete weights lack a smooth conformity to the skull, increasing the discomfort and again rendering the invention less desirable for use by patients.

Alternative band formations are seen when bands have also been used to apply pressure, heat or cool specific regions, such as the head or neck, for medicinal purposes. Exemplary patents include U.S. Pat. No. 6,190,288 to Fisher, entitled "Slim Neck Exercise Collar"; U.S. Pat. No. 5,305,470 to McKay, entitled "Sports Band"; U.S. Pat. No. 3,159,160 to Ullom, entitled "Therapeutic Appliance for Headache"; U.S. Pat. No. 4,204,543 to Henderson, entitled "Coolant Band"; and U.S. Pat. No. 5,295,949 to Hathaway, entitled "Modular Neck Apparatus", the contents and teachings of each which are incorporated herein by reference. All necessarily lack an ideal weight distribution and adjustability, with varying degrees of discomfort necessitated by design.

Additional band formations for flexibly weighted bands are illustrated in U.S. Pat. No. 3,532,339 to Smith, entitled "Flexible Weighted Belt", and U.S. Pat. No. 3,374,636 to Mason, entitled "Diver's Weight Belt", the contents and teachings of each which are incorporated herein by reference. These patents discloses a dual tube design filled with shot to allow for maximum contouring to the body, while Mason further discloses a stretchy, resilient material. In addition, the two ends Velcro together, allowing for adjustability and comfort. Furthermore, the zipper in Mason allows for an adjustment of weight in the dual tubes.

Additional patents that illustrate various additional exemplary techniques or apparatus that may be used in association with the present invention or as adjunctive therapies or treatments include U.S. Pat. No. 4,036,213 by Gregory, entitled "Process for determining vertebrae locations in humans"; U.S. Pat. No. 5,088,504 by Benesh et al, entitled "Machine and method for measuring skeletal misalignments"; U.S. Pat. No. 5,991,651 by LaBarbera, entitled "Compression/traction method for use with imaging machines"; U.S. Pat. No. 6,517,506 by Pettibon, entitled "Cervical traction device and method"; U.S. Pat. No. 6,788,968 by Pettibon, entitled "System for spinal and posture examination and treatment"; and U.S. Pat. No. 7,322,977 by Pettibon, entitled "Spinal adjusting device and method", the contents and teachings of each which are incorporated herein by reference.

Webster's New Universal Unabridged Dictionary, Second Edition copyright 1983, is additionally incorporated herein by reference in entirety for the definitions of words and terms used herein.

SUMMARY OF THE INVENTION

In a first manifestation, the invention is a head weighting appliance for kinesitherapy treatment that loads the spine in a manner to evoke the body's righting reflexes as an adjusting procedure for spinal correction, rehabilitation, and maintenance. A hollow, conformal lower ring is adapted to fit comfortably around a skull. A first adjustable closure closes and secures the lower ring at a variable circumference. An upper ring has metal shot in a forehead-adjacent weight region to apply weight load at a frontal skull section. A second adjustable closure closes and secures the upper ring at a variable circumference.

In a second manifestation, the invention is a halo head weight operative when worn about a person's head to provide a therapeutic neck exercising appliance apparatus suitable for musculoskeletal treatment of the person's spine. An upper tube at least partially circumscribes the person's head and is filled in a region associated with the person's forehead with a plurality of fine weights. A naturally expansive and conformal lower tube at least partially circumscribes the person's head. At least one fastener secures at least one of the upper and lower tubes about the person's head.

In a third manifestation, the invention is a treatment apparatus which is simultaneously comfortable to wear and which will not disrupt ordinary activities, thereby increasing patient compliance, and adapted to meet the needs of physically very diverse patients for kinesitherapy treatment that loads the spine in a manner to evoke the body's righting reflexes as an adjusting procedure for spinal correction, rehabilitation, and maintenance. A hollow, conformal, shape-sustaining lower ring is adapted to fit comfortably around a skull adjacent forehead level. A first adjustable closure closes and secures the lower ring at a variable circumference. A resilient fabric bag encompasses and contains a plurality of conformal fine weights. An upper ring supports the resilient fabric bag in a forehead-adjacent weight region to apply weight load at a frontal section of the skull. A plurality of pads operatively couple extra weight to permit correction of tilt or adjustment of weight loading. A second adjustable closure closes and secures the lower ring at a variable circumference. The upper and lower rings are fabricated from a single strip of double-backed neoprene that is formed using at least one longitudinally extensive seam.

OBJECTS OF THE INVENTION

Exemplary embodiments of the present invention solve inadequacies of the prior art by providing a dual tube head wrap fabricated from cloth-laminated neoprene rubber. The upper tube is filled in a forward central region with fine shot wrapped in a resilient fabric, while the lower tube remains empty and is naturally expansive for optimum contour and comfort.

A first object of the invention is to provide a therapeutic neck exercising appliance apparatus suitable for musculoskeletal treatment of the neck or cervical spine. A second object of the invention is to provide a head weighting appliance for kinesitherapy treatment that loads the spine in a manner to evoke the body's righting reflexes as an adjusting procedure for spinal correction, rehabilitation, and maintenance. Another object of the present invention is to provide a treatment apparatus which is simultaneously comfortable to wear and which will not disrupt ordinary activities, thereby increasing patient compliance. A further object of the invention is to provide a single apparatus which is readily adapted to meet the needs of physically very diverse patients. Yet another object of the present invention is to accomplish the foregoing objectives using readily available materials and fabrication methods.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 2:
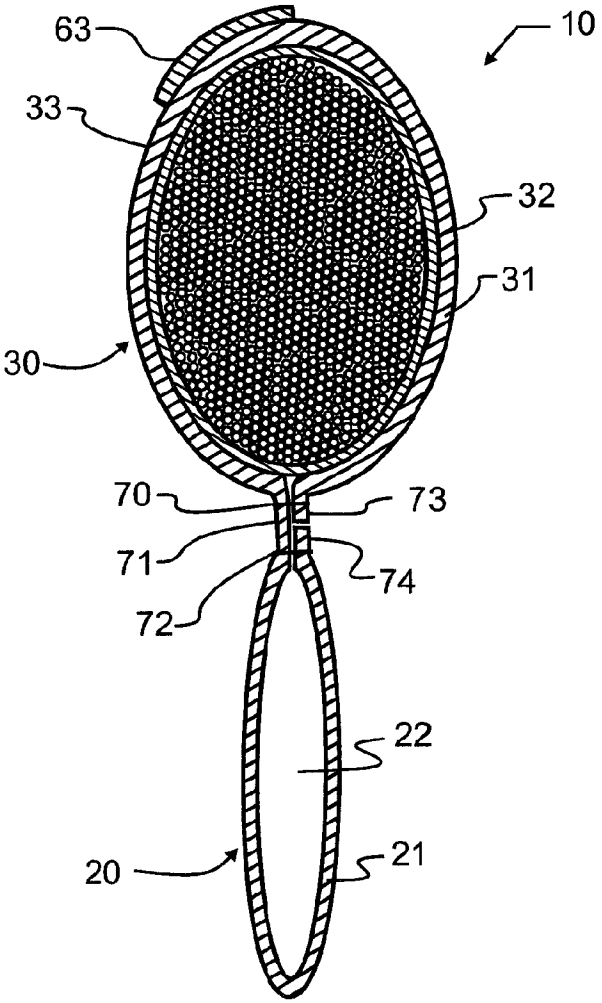
FIG. 2 illustrates the preferred embodiment from sectional view taken along section line 2' of FIG. 1.

Manifested in the preferred embodiment, the present invention provides a Halo Posture head weight 10. In a most preferred embodiment of the invention illustrated in FIG. 1, Halo Posture head weight 10 is formed into the general shape of a ring or halo, comprising a lower ring 20 and an upper ring 30. Each of the rings 20, 30 are split, meaning there is a gap that is bridged by tensioning straps 40, 50 respectively. For exemplary purposes, strap 40 may comprise a single strap having loops on one half, and hooks on the other. Strap 40 is sewn at one end 44 directly into ring 20. The other end may preferably pass first through a ring 42 or the like which is securely anchored distal to the sewn end of strap 40, and then loop back into engagement with itself. Since strap 40 has both hooks and loops, it is easily folded back onto itself, with the hooks engaging the loops. This type of fastener comprises only soft fabric, other than the rings 42, and yet is tensioned to relatively great holding force to secure the Halo Posture head weight 10 about one's head. Other suitable fasteners may be used to provide securement, and may include other devices besides straps. Many different types of belts, elastic materials, and other possibilities too numerous to mention will be understood to be incorporated herein. Strap 50 in the preferred embodiment as illustrated is of similar construction, though any suitable fastener may be used, and there is no requirement that the two straps 40, 50 be identical in construction.

Preferred embodiment Halo Posture head weight 10 is most preferably fabricated from an outer layer of double-backed neoprene rubber, such as is commonly used in the wet suit industry. Most preferably, the core is neoprene rubber or other similar compliant but yet also shape-sustaining material, while both surfaces of the core are covered or laminated with a resilient material such as Spandex or Lycra-nylon fabric. This material selection ensures good conformity to an individual, while also ensuring sufficient strength and rigidity to form the desired construction contours.

Additionally, a number of loop pads 61-63 may optionally be provided about ring 30. These loop pads allow the attachment of additional weights to the outer surface of Halo Posture head weight 10, permitting the amount of weight to be increased and selectively balanced as required to best suit a particular patient's needs.

Figure 1:
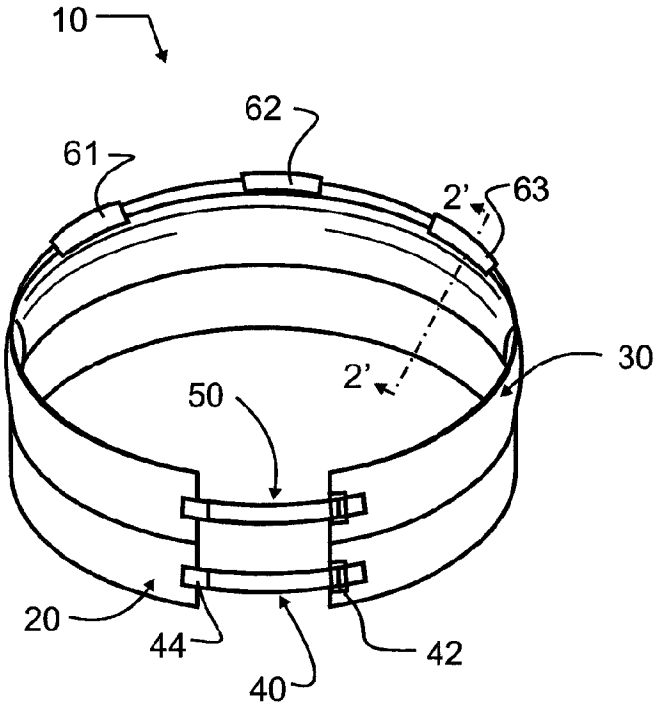
FIG. 1 illustrates a preferred embodiment of the invention from projected plan view.

FIG. 2, which illustrates Halo Posture head weight 10 via a cross-section taken along line 2' of FIG. 1, shows the preferred internal construction. Most preferably, lower ring 20 will have the wet suit material 21 formed into a loop, and a hollow or air filled core 22 therein. Owing to the semi-rigid shape-sustaining nature of the wet suit material, it will not simply collapse when folded, and so will, when not under significant external load, form the cavity 22 as illustrated. While air fill is preferred, it will be understood that other conformal materials may be incorporated within cavity 22, if so desired, and will be understood herein to be functional equivalents, such as low-density foams or any other known equivalents. Where resilient fill is incorporated, the semi-rigid shape-sustaining characteristic may be derived from either or both of the material 21 and core 22.

Upper ring 30 similarly has an outer layer 31 formed from the double-backed wet suit material. Within ring 30, and in preferred embodiment Halo Posture head weight 10 only in one-half of ring 30 distal to straps 40, 50, there is a core of small metal beads 33 such as fabricated from carbon steel or the like. Each of the beads 33 may optionally be coated with paint, varnish, electroplated materials, or other suitable materials to reduce any tendency of the beads 33 to oxidize. The use of small beads ensures that even the beads will conform to a person, but small beads may tend to escape from seams sewn into the wet suit material. To prevent such escape, these beads 33 are first inserted into a tube 32, such as might be fabricated from a Lycra-nylon blend, to ensure they are held securely within ring 30 and do not escape therefrom. The use of tube 32 also simplifies manufacturing of Halo Posture head weight 10.

In the preferred embodiment Halo Posture head weight 10, rings 20, 30 are, in fact, both formed from a single sheet of double-backed wet suit material which has a first edge 73. From this first edge 73, the single sheet wraps upward along an exterior surface of ring 30, including adjacent loop pads 61-63, then folds at the apex thereof and wraps back down along what forms the interior of Halo Posture head weight 10, including both ring 30 and ring 20, folding again at the lower portion of ring 20, and wrapping out to the exterior of ring 20, and finally ending at the opposite edge 74 of the original single sheet of material. To hold the shape securely, stitching 70, 72 may be provided, or other suitable technique used to securely close rings 20, 30. This construction forms a small bridge 71 between rings 20, 30 which is also quite resilient and conformal.

A person will use Halo Posture head weight 10 by opening straps 40, 50 and placing Halo Posture head weight 10 about their head, with ring 30 above ring 20. In most cases, beads 33 will preferably rest adjacent the person's forehead, while straps 40, 50 will be at the back of the head above the spinal column. With such placement, resembling that of wearing a crown, the person can receive beneficial muscular-skeletal redevelopment through ordinary motions or specific exercises. The use of strong, yet conformal materials ensures that Halo Posture head weight 10 wraps comfortably and yet securely about the wearer's head, and conforms to the bumps and bulges that are so common on the human head. The lower hollow ring 20 will first contact the person's head with only a single layer of wet suit material. Should there be any irregularities, this single layer will readily conform, just as a wet suit does about a person's body. The exterior portion of ring 20 will tighten about the protrusions or bulges, but will be augmented to hold better about the human head by the interior which will follow the indents or less protruding regions.

Halo Posture head weight 10 may be designed in any suitable diameter, and may additionally contain any suitable amount of weight obtained from beads 33. However, rather than an individual having to purchase a large number of differently weighted Halo Posture head weights 10, loop pads 61-63 provide additional attachment points for further weighting. These loop pads 61-63 additionally permit uneven balancing of Halo Posture head weight 10, if so desired. A weight which is provided with hooks will be pressed gently against one or more of loop pads 61-63, and will be adhered thereto if so desired.

Figure 3:
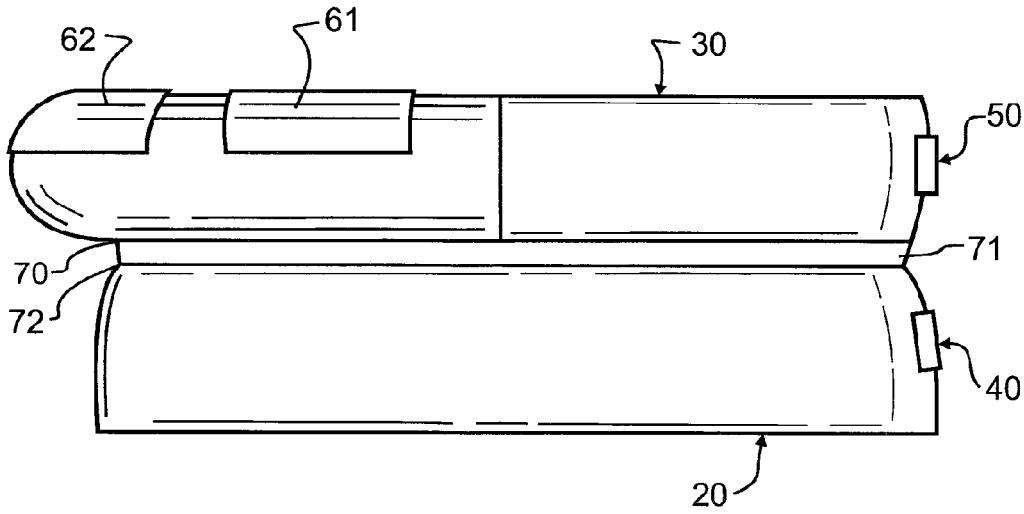
FIG. 3 illustrates the preferred embodiment of the invention from side view.
Figure 4:
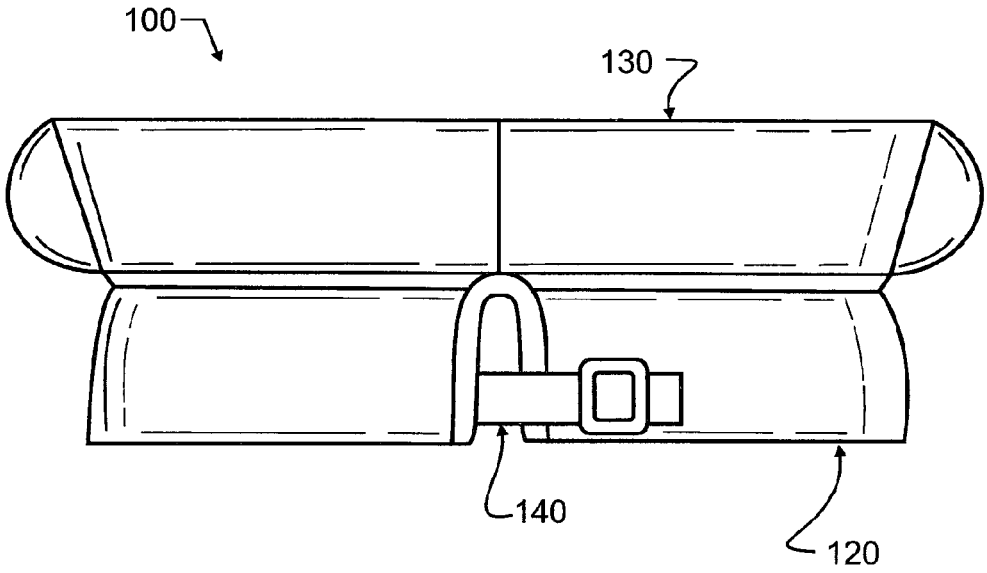
FIG. 4 illustrates an alternative embodiment of the invention from back view.

FIG. 4 illustrates a first alternative embodiment 100 of the invention from back view. In this first alternative embodiment, the weighted ring 130 is a continuous ring, while lower ring 120 is split with a single strap 140 bridging the gap. This design is less adaptable to various head sizes, and there is a significant loss of conformity when compared to lower ring 20 found in preferred embodiment Halo Posture head weight 10 of FIGS. 1-3.

A variety of designs have been contemplated for Halo Posture head weight 10, and may further include diverse surface ornamentations or even decorative, simulative, or thematic geometries. A variety of alternative materials will be recognized by those working in the field of the present invention as being useful, and those materials may also factor in and complement the surface ornamentation or geometries.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A head weighting appliance for kinesitherapy treatment that loads the spine in a manner to evoke the body's righting reflexes as an adjusting procedure for spinal correction, rehabilitation, and maintenance, comprising:

a hollow, conformal lower ring adapted to fit comfortably around a skull;

a first adjustable closure closing and securing said lower ring at a variable circumference;

an upper ring having metal shot only in one half of the upper ring in a forehead-adjacent weight region to apply weight load at a frontal section of said a skull, said upper ring connected to said lower ring;

at least one coupling pad provided about an upper, outer surface of said upper ring, operative to selectively couple extra weight to said upper ring to permit correction of tilt and adjustment of weight loading; and a second adjustable closure distal to said forehead-adjacent weight region closing and securing said upper ring at a variable circumference.

2. The head weighting appliance of claim 1, wherein said hollow, conformal lower ring further comprises a shape-sustaining material adapted to fit comfortably around a skull.

3. The head weighting appliance of claim 2, wherein said hollow, conformal lower ring fits comfortably around a skull at the level of the forehead.

4. The head weighting appliance of claim 1, wherein said metal shot further comprises coated metal.

5. The head weighting appliance of claim 1, wherein said lower and upper rings further comprise a single strip of double-backed neoprene formed using two longitudinally extensive seams.

6. The head weighting appliance of claim 1, further comprising a resilient fabric bag interior of said upper ring securing said metal shot therein.

7. A halo head weight operative when worn about a person's head to provide a therapeutic neck exercising appliance apparatus suitable for musculoskeletal treatment of the person's spine, comprising:

an upper tube configured to operatively at least partially circumscribe a person's head and filled only in a forehead region operatively adjacent with a person's forehead with a plurality of fine weights;

at least one pad provided about an upper, outer surface of said upper tube, operative to removably couple an additional weight to said upper tube to permit correction of tilt and adjustment of weight loading;

a naturally expansive and conformal lower tube connected to said upper tube and configured to operatively at least partially circumscribe a person's head; and at least one fastener configured to operatively secure smiling at least one of said upper and lower tubes about said a person's head.

8. The halo head weight of claim 7, wherein said fine weights further comprise metal shot.

9. The halo head weight of claim 8, wherein said metal shot further comprises an environmentally protective coating.

10. The halo head weight of claim 7, further comprising a resilient fabric tube encapsulating said fine weights and contained within said forehead region.

11. The halo head weight of claim 7, wherein said naturally expansive and conformal lower tube further comprises a hollow tube.

12. The halo head weight of claim 11, wherein said naturally expansive and conformal lower tube is semi-rigid and shape-sustaining.

13. The halo head weight of claim 12, wherein said naturally expansive and conformal lower tube further comprises double-faced neoprene rubber.

14. The halo head weight of claim 7, wherein said upper and lower tubes further comprise unitary cloth-laminated neoprene rubber.

15. A treatment apparatus which is simultaneously comfortable to wear and which will not disrupt ordinary activities, thereby increasing patient compliance, and adapted to meet the needs of physically very diverse patients for kinesitherapy treatment that loads the spine in a manner to evoke the body's righting reflexes as an adjusting procedure for spinal correction, rehabilitation, and maintenance, comprising:

a generally hollow, conformal, shape-sustaining lower ring adapted to fit comfortably around a forehead level of a skull;

a first adjustable closure closing and securing said lower ring at a variable circumference;

a resilient fabric bag encompassing and containing a plurality of conformal fine weights;

an upper ring having said resilient fabric bag confined and limited to a forehead-adjacent weight region to apply weight load at a frontal section of a skull and a plurality of pads provided about an upper, outer surface of said outer ring, operative to couple extra weight to permit correction of tilt and adjustment of weight loading; and a second adjustable closure closing and securing said upper ring at a variable circumference;

said upper and lower rings fabricated from a single strip of double-backed neoprene that is formed using at least one longitudinally extensive seam.

16. The treatment apparatus of claim 15, wherein said second adjustable closure is located distally to said forehead-adjacent weight region.

17. The treatment apparatus of claim 15, wherein said generally hollow, conformal, shape-sustaining lower ring further comprises low-density foam filler material therein.

* * * * *